US006161623A

United States Patent [19]

Shin

[11] Patent Number: 6,161,623

[45] Date of Patent: Dec. 19, 2000

[54] METHOD AND APPARATUS FOR CONTROLLING FIRE AND SMOKE

[76] Inventor: Dong-Won Shin, #401, Sinwon villa, 1132, Eunhang-dong, Joongwon-gu, Songnam, Kyeonggi-do, 462-150, Rep. of Korea

[21] Appl. No.: 09/171,254

[22] PCT Filed: Apr. 25, 1997

[86] PCT No.: PCT/KR97/00064

§ 371 Date: Mar. 5, 1999

§ 102(e) Date: Mar. 5, 1999

[87] PCT Pub. No.: WO97/39801

PCT Pub. Date: Oct. 30, 1997

[30] Foreign Application Priority Data

Apr. 25, 1996 [KR] Rep. of Korea ..... 96/12971

[51] Int. Cl.[7] ..... A62C 35/00

[52] U.S. Cl. ..... 169/9; 169/43; 169/48; 169/56

[58] Field of Search ..... 169/5, 16, 9, 43, 169/45, 48, 51, 56, 60, 70, 64; 239/548, 565; 222/146.6

[56] References Cited

U.S. PATENT DOCUMENTS

| | | | |
|---|---|---|---|
| 3,050,134 | 8/1962 | Multin | 169/5 |
| 4,079,786 | 3/1978 | Moling | 169/16 |
| 4,121,790 | 10/1978 | Graham | 169/48 |
| 4,345,654 | 8/1982 | Carr | 169/14 |
| 5,353,879 | 10/1994 | Watanabe | 169/52 |

FOREIGN PATENT DOCUMENTS

| | | | |
|---|---|---|---|
| 0227255 | 7/1987 | European Pat. Off. . | |
| 3106110 | 9/1982 | Germany . | |
| 0158309 | 1/1983 | Germany | 169/48 |
| 3234968 | 3/1984 | Germany | 169/48 |
| 0860769 | 9/1981 | U.S.S.R. | 169/48 |
| 2181050 | 4/1987 | United Kingdom . | |
| 2203829 | 10/1988 | United Kingdom | 169/48 |
| 9501816 | 1/1995 | WIPO . | |

*Primary Examiner*—Andres Kashnikow
*Assistant Examiner*—Jorge Bocanegra

[57] ABSTRACT

Control of smoke and fire in a region threatened by a fire through the use of an exit door and a doorcase around an exit door is accomplished in such a manner to first supply water from a water source to a water supply tube which is connected to the doorcase in a constant level of pressure by a pump. The water supply tube which is connected to the doorcase in a constant level of pressure by a pump. The water supply tube is provided with a solenoid valve for controlling the water flow into the doorcase and a branch-connecting portion. Further, pressurized air is supplied to an air supply tube connected to the branch-connecting portion to fluid-communicate with the water supply tube. The air supply tube is provided with an air solenoid valve for controlling the airflow into the branch-connecting portion. The solenoid valve is opened to render the water to flow into the doorcase having a plurality of nozzle holes facing to the exit door, if a fire is detected either by a detector or a manual actuator. Further, the air solenoid valve is opened to render the air under pressure to flow into the branch-connecting portion, if opening the exit door is detected by a pressure sensor.

6 Claims, 5 Drawing Sheets

METHOD AND APPARATUS FOR CONTROLLING FIRE AND SMOKE

This application is the national phase under 35 U.S.C. §371 of prior PCT International Application No. PCT/KR97/00064 which has an International filing date of Apr. 25, 1997 which designated the United States of America, the entire contents of which are hereby incorporated by reference.

FIELD OF THE INVENTION

The present invention is directed to a method and apparatus for controlling fire and smoke in an area threatened by fire; and, more particularly, to an improved method and apparatus for excluding smoke from people suffering from fire so that an escapee can move to a safe place without the danger caused by smoke and an escapee can survive without danger caused by smoke inhalation until a rescue team saves him.

DESCRIPTION OF THE PRIOR ART

There are two known types of conventional methods for controlling smoke in an area threatened by fire. One type of method is the forced air charging method wherein air pressure in a control section is greater than that in a remainder section, thereby preventing smoke in the remainder section from permeating into the control section. The other is the charging and exhausting method wherein smoke within the control section is exhausted compulsorily from the control section and, at the same time, fresh air is supplied to the control section.

In the forced air charging method, since air pressure is maintained in the control section in order to prevent smoke generated outside the control section from permeating thereinto, it is difficult for the old and the weak or a child outside the control section to open an exit door due to the high air pressure generated therein. Further, in the forced air charging method, if an exceedingly large amount of air is supplied to the control section, there may be a further spread of fire or an inadvertent counter flow of smoke and heat toward a corridor.

The charging and exhausting method has two advantages. One is that smoke permeating into the control section is exhausted compulsorily from the control section. The other resides in that the method can reduce the possibility of the smoke permeation by keeping a pressure within the control section greater than the remainder, e.g., in such a manner that a flow rate of the supply air is kept higher than the flow rate of the exhaust smoke by 50% of the latter. Though greater pressure is maintained within the control section, however, in the tope level of the control section, the smoke permeation is not reduced due to an imbalance between the flow rate of the supply air and the exhaust smoke.

Further, the charging and exhausting method requires mechanical power to charge air and exhaust smoke, thereby rendering the whole control device complicated and requiring careful adjustment of the flow rates.

On the other hand, the methods also have a common fatal flaw that when an emergency exit door is opened, both methods cannot maintain a required minimum pressure within a control section, e.g., in an emergency stairway, the control section is charged with smoke easily due to a chimney draft.

SUMMARY OF THE INVENTION

It is, therefore, a primary object of the present invention to provide a smoke-control system capable of solving the problems of the prior art smoke-control apparatuses.

Further objects of the present invention are accomplished by providing a method and apparatus for controlling smoke and fire in a region threatened by a fire, wherein a pump supplies water to a water supply tube connected to the doorcase from a water reservoir sustaining a constant level of pressure, the pump being actuated by a signal from a power controller actuated by a receiver, and the water supply tube is provided with a solenoid valve for controlling water flow into the doorcase depending upon a signal from the receiver, and the water supplied to the doorcase is sprayed through a plurality of nozzle holes formed within the doorcase to prevent smoke permeation through a gap between the doorcase and the exit door, and when an escapee opens the exit door, a pressure sensor allows pressurized air from an air reservoir to flow into a branch connecting portion to be mixed with the water from the water supply tube.

The present invention is further characterized by a compressor that is energized by a power controller actuated by a signal from a receiver to produce pressurized air which is supplied to a doorcase through an air supply tube to prevent smoke permeation through a gap between the doorcase and the exit door.

BRIEF DESCRIPTION OF THE DRAWINGS

The objects and features of the present invention will become more apparent from the following description of preferred embodiments taken in conjunction with the accompanying drawings, in which.

DETAILED DESCRIPTION OF THE PREFERRED EMBODIMENTS

Figure 1:
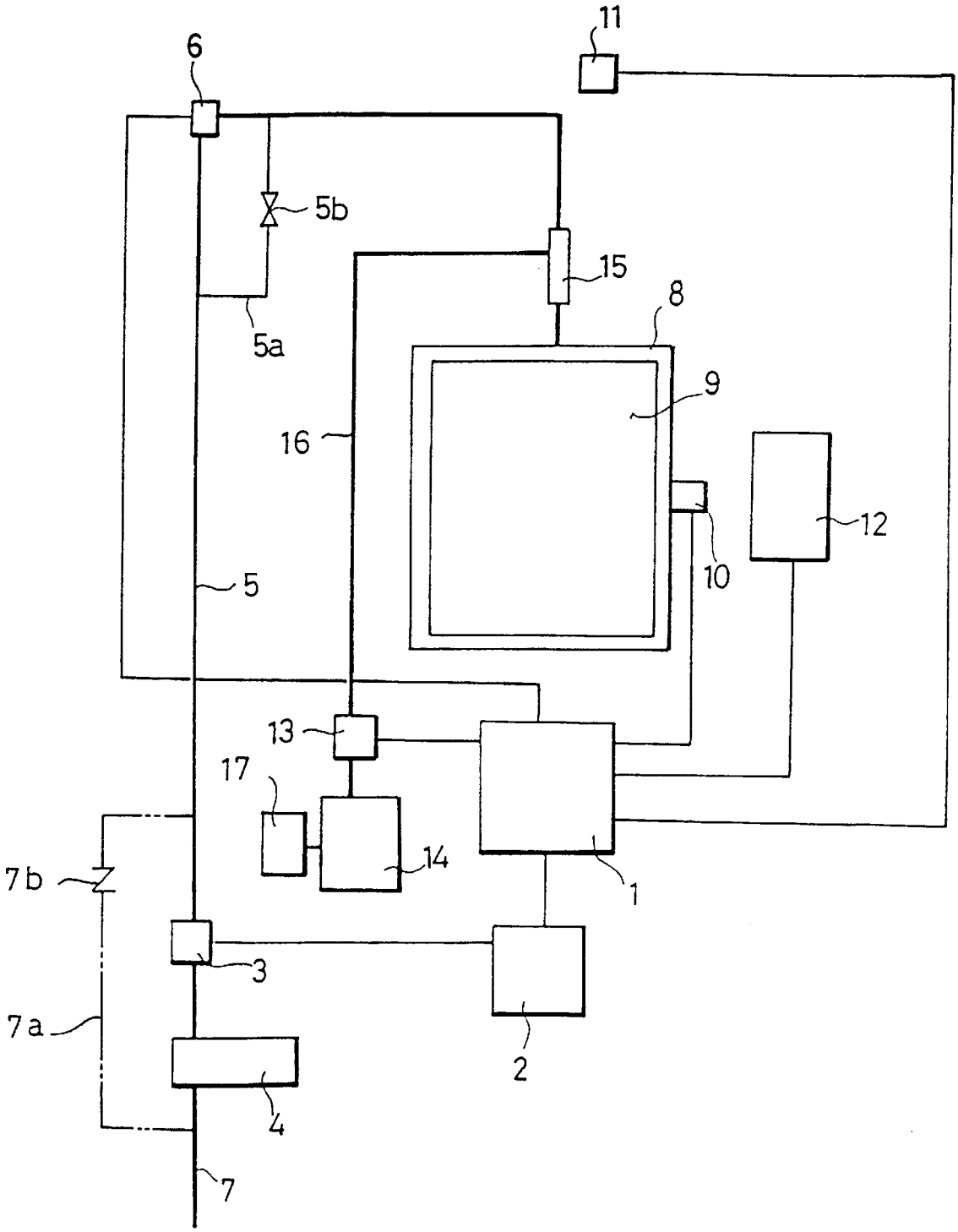
FIG. 1 shows a whole block diagram of the inventive system.

As shown in FIG. 1, a pump 3 supplies water from a reservoir 4 to a water supply tube 5 connected to a doorcase 8 at a predetermined level of water pressure and flow rate. The water in the reservoir 4 is supplied from a water source tube 7 according to a signal from a receiver 1 and a power controller 2. If the water from the water source tube 7 is maintained at the required level of pressure and flow rate, the water source tube 7 can be connected directly to the water supply tube 5 via an auxiliary tube 7*a*. In this case, a check valve 7*b* should be installed in the auxiliary tube 7*a* in order to prevent an inadvertent counter flow.

The water supply tube 5 includes a solenoid valve 6 for controlling water flow into the doorcase 9 that is actuated by a signal from the receiver 1. The water supply tube 5 further includes a bypass tube 5*a* equipped with a separate emergency operation valve 5*b* in order to manually control the water flow into the doorcase 9 independent of the solenoid valve 6.

The receiver 1 is electrically connected to a detector 11 to thereby be actuated by the same 11. In order for a person to manually operate the receiver 1, it is further electrically connected to a manual actuator 12. The receiver 1 is further electrically connected to a pressure sensor 10 mounted on the doorcase 8 for detecting a pressure exceeding a predetermined level from the doorcase 8 and an exit door 9.

Figure 2:
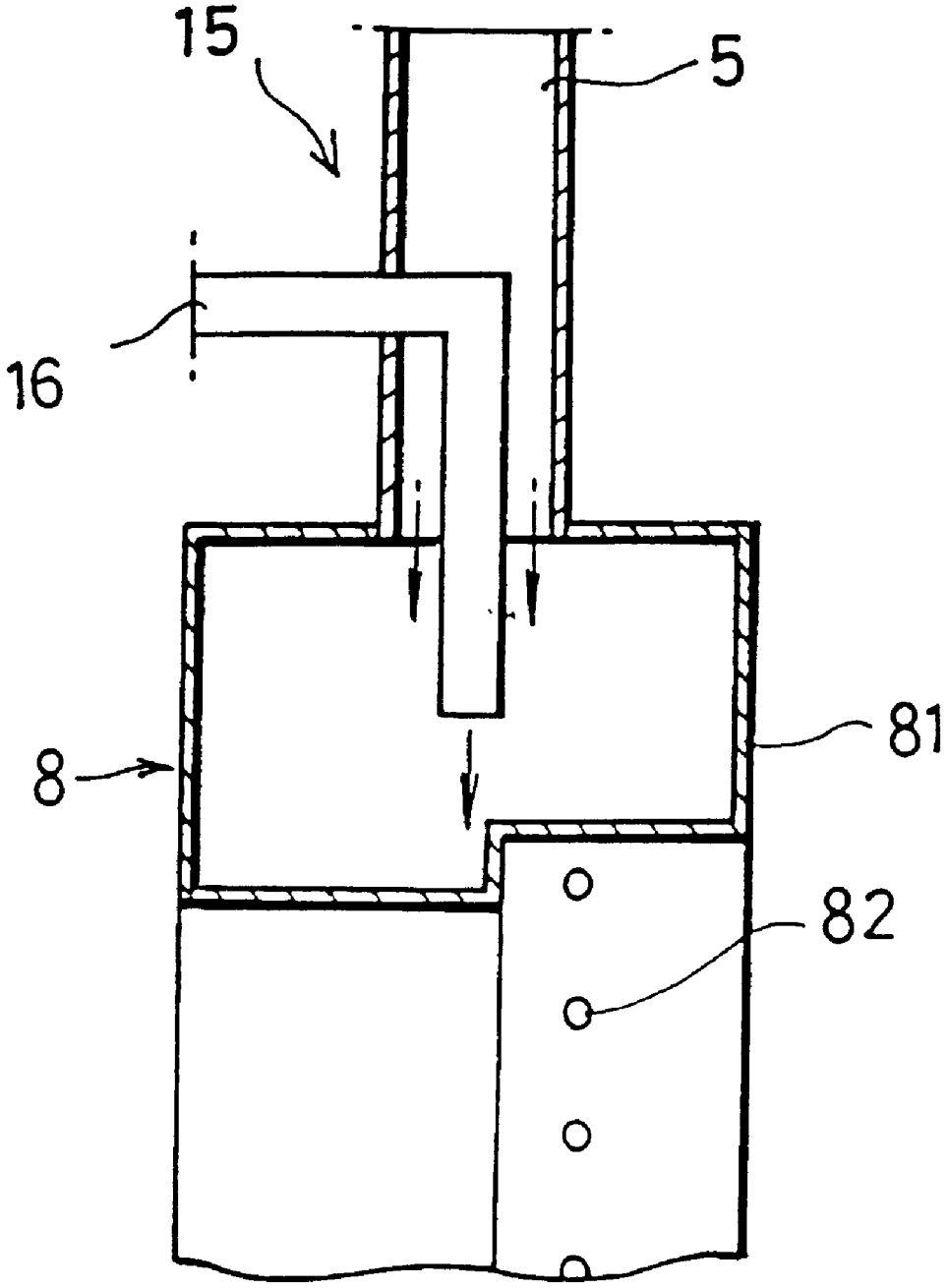
FIG. 2 illustrates a partial enlarged section view of a branch connecting portion employed in the present invention.

As shown in FIG. 2, in order to mix pressurized air with water, an air supply tube 16 is connected to a branch connecting portion 15 mounted to the water supply tube 5 adjacent to the doorcase 8. The air supply tube 16 is provided with an air solenoid valve 13 for controlling airflow which is actuated by a signal from the pressure sensor 10 through the receiver 1. The air supply tube 16 is further connected to an air reservoir 14 charged with the air under pressure by a compressor 17.

Figure 3:
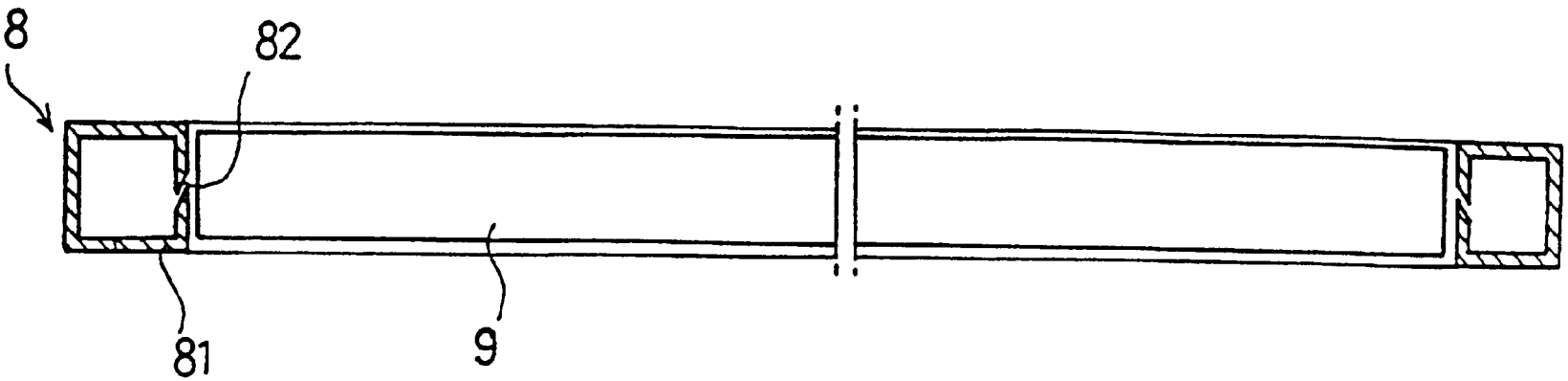
FIG. 3 depicts a partial enlarged sectional view of a doorcase employed in the present invention.

As shown in FIG. 3, the doorcase 8, in accordance with the present invention, is of a rectangular form 81. The water supply tube 5 extends through an exterior part of the rectangular frame 81. A plurality of nozzle holes 82 are formed through an interior part of the rectangular frame 81 to prevent smoke permeation through a gap between the doorcase 8 and the exit door 9 in such a way that the sprayed water via the nozzle holes 82 seals the gap.

The operation and effect of the present invention constructed in this manner is as follows.

When a fire occurs, the detector 11 mounted on, e.g., a ceiling, detects smoke and sends the receiver 1 a signal. Then, the receiver 1 operates the pump 3 via the power controller 2 to maintain the water in the water supply tube 5 at a predetermined level of pressure and actuates the solenoid valve 6 to supply the water in the water supply tube 5 to the doorcase 8.

Next, the water supplied to the doorcase 8 via the water supply tube 5 terminates within the rectangular frame 81 and is sprayed to a gap between a doorcase 8 and the exit door 9 via a plurality of nozzle holes 82 at a predetermined level of pressure and flow rate, preventing smoke permeation via the gap. In this manner, the present invention can keep a particular section from being contaminated with smoke. As a result, a trapped person is able to survive, waiting for rescue without the danger caused by inhaling poisonous gas.

If the detector 11 cannot detect smoke, or a man finds fire in advance of the detector 11, the manual actuator 12 electrically connected to the receiver 1 can allow the receiver 1 to generate the signal needed to launch the normal operation of the whole mechanism aforementioned above.

Furthermore, if the water supply from the water supply tube 5 to the doorcase is not achieved due to a malfunction of the solenoid valve 6 or the receiver 1, the emergency operation valve 5*b* of the bypass tube 5*a* can be opened manually to allow the water to be supplied to the doorcase 8.

Meanwhile, when an escapee opens the exit door 9, an operative signal from the pressure sensor 10 is transmitted to the air solenoid valve 13 through the receiver 1 and the air supply tube 16, which actuates the air solenoid valve 13, and allows pressurized air within the air reservoir 14 to be supplied to the branch connecting portion 15. Accordingly, the water supplied through the water supply tube 5 is mixed with pressurized air. The mixture of the water and the pressurized air is sprayed to the exit door 9 through the nozzle holes 82 at a high level of speed. As a result, the water is atomized by the pressurized air and a reaction force of the sprayed water allows the exit door 9 to be easily opened. The atomized water functions as a membrane preventing smoke from permeating the space caused by opening the exit door 9.

Further, as described above, the pressure caused by the water and air ensures protection of the escapee, and the sprayed water not only prevents the additional spread of fire, but also extinguishes the fire.

Figure 4:
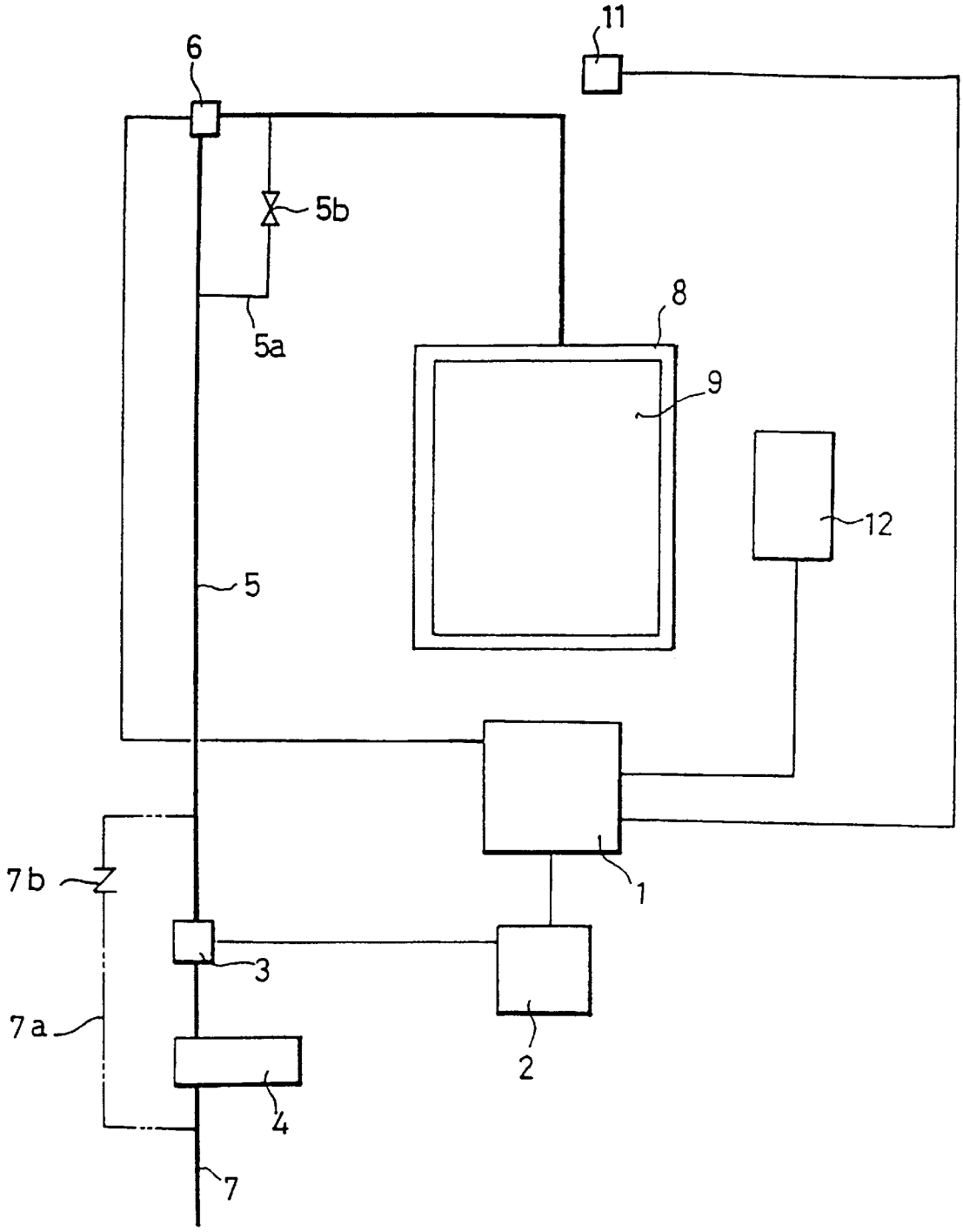
FIGS. 4 and 5 represent modifications of the present invention, respectively.

Referring to FIG. 4, the present invention's embodiment of the air supply device is illustrated. Water is sprayed into a gap between the doorcase 8 and the exit door 9 at a predetermined level of pressure and flow rate, preventing smoke permeation via the gap. In this manner, the present invention can prevent a particular section from being contaminated with smoke. As a result, even a person who failed to escape is able to survive while waiting for rescue without danger caused by inhaling poisonous gases.

Figure 5:
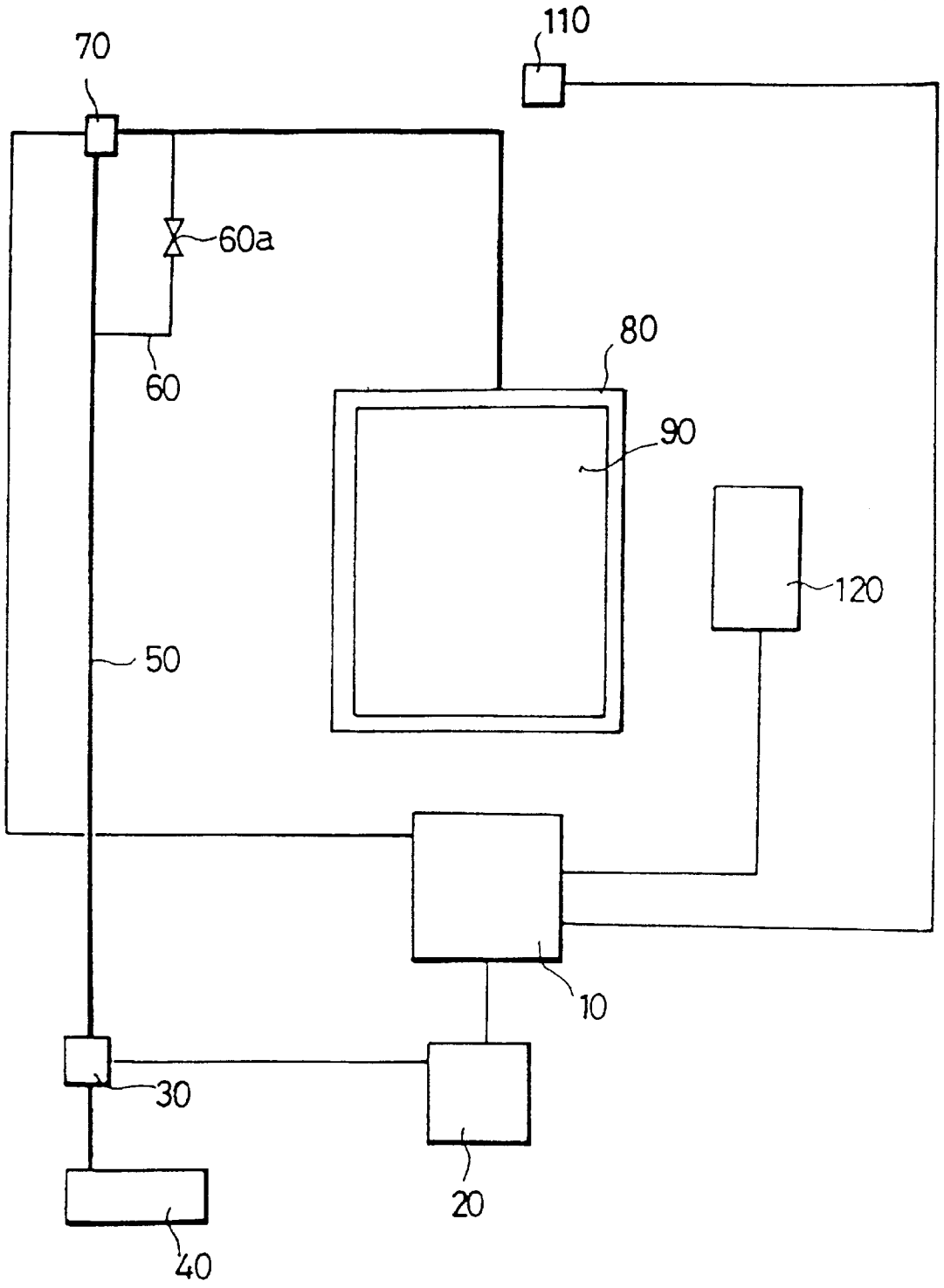

A modification of the present invention is shown in FIG. 5. An air supply tube 50 is connected to an air reservoir 30, which contains pressurized air produced by a compressor 40. The air supply tube 50 is also connected to a doorcase 80. The air supply tube is provided with a solenoid valve 70 for controlling air flow into the doorcase, which is actuated by a signal sent from a detector 110 or a manual actuator 120 through a receiver 10. The air supply tube 50 is further provided with a bypass tube 60 having an emergency operation valve 60*a*.

The operation of the modification of the present invention constructed in this manner is described as follows.

When a fire occurs, the detector 110 mounted on, e.g., a ceiling, detects smoke and sends the receiver 10 a signal. Then, the receiver 10 actuates the solenoid valve 70 to supply the pressurized air in the air reservoir 30 to the doorcase 80 via the air supply tube 50. In this state, the air supplied to the doorcase 80 via the air supply tube 50 is sprayed into a gap between the doorcase 80 and an exit door 90, preventing smoke permeation via the gap. In this manner, the present invention can prevent a particular section from being contaminated with smoke. As a result, even a person who failed to escape is able to survive while waiting for rescue without the danger caused by inhaling of poisonous gas.

Although the invention has been shown and described with respect to the preferred embodiments, it will be understood by those skilled in the art that various changes and modifications may be made without departing from the spirit and scope of the invention as defined in the following claims.

What is claimed is:

1. A method for controlling smoke and fire in a region threatened by a fire through the use of an exit door and a doorcase around the exit door, said method comprising the steps of:

(a) supplying water to a water supply tube, which is connected to the doorcase, at a constant level of pressure by a pump, the water supply tube connected in fluid-communication with a solenoid valve for controlling the water flow into the doorcase and a branch connecting portion;

(b) supplying air under pressure from an air reservoir to an air supply tube which is connected to the branch connecting portion to fluid-communicate with the water supply tube, the air supply tube connected in fluid-communication with an air solenoid valve for controlling the air flow into the branch connecting portion;

(c) opening the solenoid valve to allow the water to flow into the doorcase having a plurality of nozzle holes facing the exit door, if an occurrence of fire is detected by either a detector or a manual actuator; and (d) opening the air solenoid valve to render the air under pressure to flow into the branch connecting portion, if opening the exit door is detected by a pressure sensor.

2. An apparatus for controlling smoke and fire in a region threatened by a fire through the use of an exit door and a doorcase around the exit door, said apparatus comprising:

a receiver actuated by a signal from either of a detector and a manual actuator;

a water supply tube connected to the doorcase;

a pump for supply water to the water supply tube from a water source at a constant level of pressure, the pump being actuated by a signal from a power controller actuated by the receiver;

a solenoid valve installed in fluid communication with the water supply tube to control a water flow into the doorcase depending upon a signal from the receiver;

a branch connecting portion connected to the water supply tube;

an air supply tube connected to the branch connecting portion to thereby fluid-communicate with the water supply tube; and an air solenoid valve installed in fluid-communication with the air supply tube to control an air flow into the doorcase depending upon a signal from a pressure sensor.

3. The apparatus for controlling smoke and fire of claim 2, further comprising a bypass tube provided with a check valve, said bypass tube connected, at its one end, to a portion of the water supply tube between the solenoid valve and the pump and connected to the water source at the other end thereof.

4. The apparatus for controlling smoke and fire of claim 2, further comprising a bypass tube provided with an emergency operation valve for manually control the water flow into the doorcase, said bypass tube connected to a frontal and a rear portions of the water supply tube about the solenoid valve.

5. The apparatus for controlling smoke and fire of claim 2, further comprising a bypass tube provided with a check valve, said bypass tube connected, at its one end, to a portion of the water supply tube between the solenoid valve and the pump and connected to the water source at the other end thereof.

6. The apparatus for controlling smoke and fire of claim 2, further comprising a bypass tube provided with an emergency operation valve for manually control the water flow into the doorcase, said bypass tube connected to a frontal and a rear portions of the water supply tube about the solenoid valve.

* * * * *